US008375618B1

(12) United States Patent
Aloraier

(10) Patent No.: US 8,375,618 B1
(45) Date of Patent: Feb. 19, 2013

(54) SHOULDER-FIRED GRENADE LAUNCHER

(76) Inventor: Adel Y. A. D. Aloraier, Alqurawan (KW)

( * ) Notice: Subject to any disclaimer, the term of this patent is extended or adjusted under 35 U.S.C. 154(b) by 0 days.

(21) Appl. No.: 13/595,847

(22) Filed: Aug. 27, 2012

(51) Int. Cl.
*F41A 19/58* (2006.01)

(52) U.S. Cl. ..... 42/105; 42/84; 89/28.05

(58) Field of Classification Search ..... 42/51, 84, 42/105; 89/1.3, 27.11, 28.05, 28.1
See application file for complete search history.

(56) References Cited

U.S. PATENT DOCUMENTS 291,288 A * 1/1884 Brown ..... 42/84
3,854,231 A 12/1974 Broyles
3,864,862 A * 2/1975 Brunger et al. ..... 42/84
4,270,293 A * 6/1981 Plumer et al. ..... 42/105
4,730,407 A * 3/1988 DeCarlo ..... 42/84
5,883,329 A 3/1999 O'Dwyer
6,374,525 B1 * 4/2002 Thomas ..... 42/51
6,477,801 B1 11/2002 O'Dwyer
6,557,449 B1 5/2003 O'Dwyer
7,197,843 B2 * 4/2007 Oertwig ..... 42/51

* cited by examiner

*Primary Examiner* — Gabriel Klein
(74) *Attorney, Agent, or Firm* — Richard C. Litman

(57) ABSTRACT

The shoulder-fired grenade launcher includes an electrical firing mechanism powered by a suitable small electrical power source, e.g., a nine-volt dry cell battery. A battery voltage indicator is provided at the side of the action of the weapon. The weapon has a relatively short barrel, capable of firing a single muzzle-loaded round with each firing. The round is only slightly shorter than the barrel. Reliefs are provided at the sides of the muzzle to enable the operator to extract the spent shell from the barrel. An electrical safety switch is provided. LEDs or other suitable lights indicate the status of the safety switch. Closure of the electrical circuit for firing the projectile is accomplished by an electrical toggle switch used for the trigger.

5 Claims, 5 Drawing Sheets

SHOULDER-FIRED GRENADE LAUNCHER

BACKGROUND OF THE INVENTION

1. Field of the Invention

The present invention relates to weaponry, and particularly to a shoulder-fired grenade launcher using an electronic firing system.

2. Description of the Related Art

Military weaponry using ballistically fired rounds or shells containing explosive charges have been known for a considerable period of time. Historically, the explosive rounds or shells have been of such a large and heavy mass that a correspondingly large weapon was required to launch them, with the weapon being of greater size and weight than could be carried by an individual. More recently, a number of smaller and lighter weapons capable of being carried by a single individual and launching an explosive round have been developed. Some of these weapons utilize an explosive rocket charge to launch the explosive projectile, e.g., the bazooka of the World War II era and the later M-72 LAW (Light Antitank Weapon). However, other recoil-type weapons capable of being carried and fired by a single individual and launching an explosive round have been developed, e.g., the U.S. military M-79 grenade launcher.

While the M-79 is an excellent weapon for certain operations, it is limited by its relatively small 40 mm caliber or bore. The corresponding round or shell cannot be expanded to provide a great deal of range when fired, nor to provide a particularly large explosive force when the round hits the target. The M-72 LAW provides somewhat greater firepower from its 66 mm bore and correspondingly sized projectile, but the LAW is a recoilless weapon, with the projectile having an explosive rocket charge for propelling it from the launch tube. Moreover, the LAW is a disposable weapon, and is discarded after a single firing. It cannot be reloaded and reused. While the bazooka round was fired electrically by a dry cell battery contained in the launcher, the M-72 and M-79 both use mechanical percussion to fire the round, i.e., the rocket of the M-72 and the explosive grenade round of the M-79.

Thus, a shoulder-fired grenade launcher solving the aforementioned problems is desired.

SUMMARY OF THE INVENTION

The shoulder-fired grenade launcher comprises a short, relatively large diameter barrel for firing a single explosive round, e.g., a weapon-launched grenade, therefrom. The round is approximately the same length as the barrel. The barrel has laterally opposed reliefs therein for the manual extraction of the spent shell by the operator. The barrel includes a depending forward handgrip. The action of the weapon extends rearward from the chamber of the barrel, and includes an electronic firing mechanism therein. The trigger comprises an electric toggle switch, and an electric slide switch serves as the safety for the weapon. Light emitting diodes (LEDs) may be incorporated to indicate the status of the safety. A small battery, e.g., a nine-volt dry cell, is used to fire the round in the weapon. A battery voltage indicator is also provided on or near the action of the weapon.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
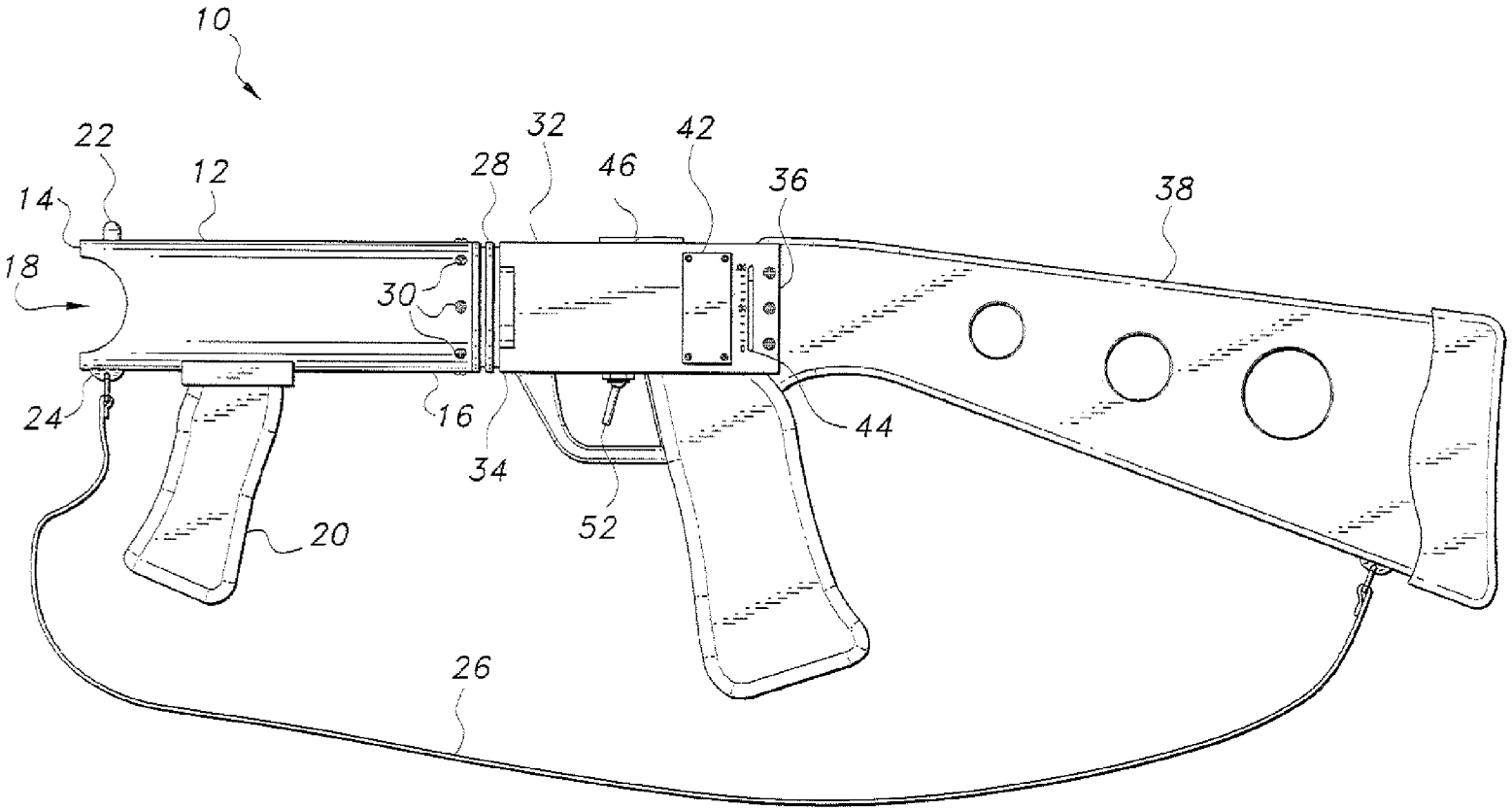
FIG. 1 is a left side elevation view of a shoulder-fired grenade launcher according to the present invention, illustrating its basic configuration and features.

The shoulder-fired grenade launcher provides a means for military personnel to launch projectile fired explosive grenades at a relatively great distance from the operator to the target. FIG. 1 of the drawings provides a left side elevation view showing the general configuration of the grenade launcher 10. The grenade launcher 10 includes a relatively short barrel 12 that is little, if any, longer than the explosive round and its shell. The barrel 12 has a distal muzzle end 14 and an opposite proximal chamber end 16 that attaches to a chamber end plate. The muzzle end 14 of the barrel 12 may include laterally opposed first and second reliefs 18 therein to facilitate the removal of a grenade round or spent shell after firing the weapon 10. While only the first or left of the two reliefs 18 is shown in the left side elevation view of FIG. 1, it will be understood that the barrel 12 is laterally symmetrical, having one relief 18 to each side of the muzzle 14. The barrel 12 may also include a forward handgrip 20 depending therefrom, a front sight 22 atop the muzzle end 14, and a forward attachment 24 for a sling 26.

A chamber end plate 28 is affixed over the chamber end 16 of the barrel 12 by a plurality of radially disposed screws 30. The chamber end plate 28 not only serves as a rearward wall for the chamber end 16 of the barrel 12, but also serves to secure the electrical firing contact assembly (discussed further below) and to attach the action 32 of the grenade launcher 10 to the chamber end 16 of the barrel 12. The action 32 has a chamber end plate attachment end 34 and an opposite stock attachment end 36. The stock 38 extends rearward from the stock attachment end 36 of the action 32.

Figure 2:
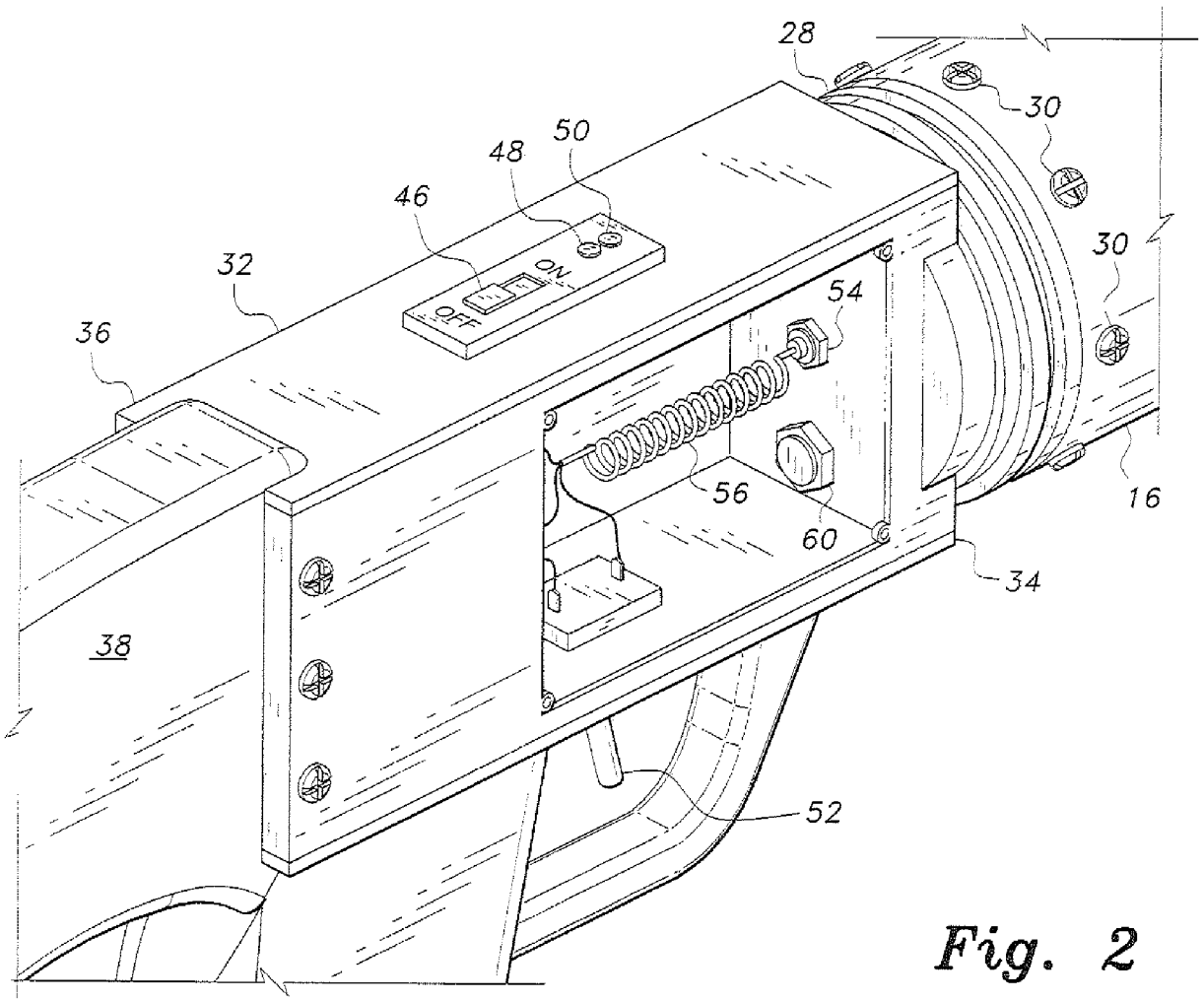
FIG. 2 is a partial right side perspective view of the shoulder-fired grenade launcher of FIG. 1, shown with the action open to show details of the electronic firing mechanism.
Figure 3:
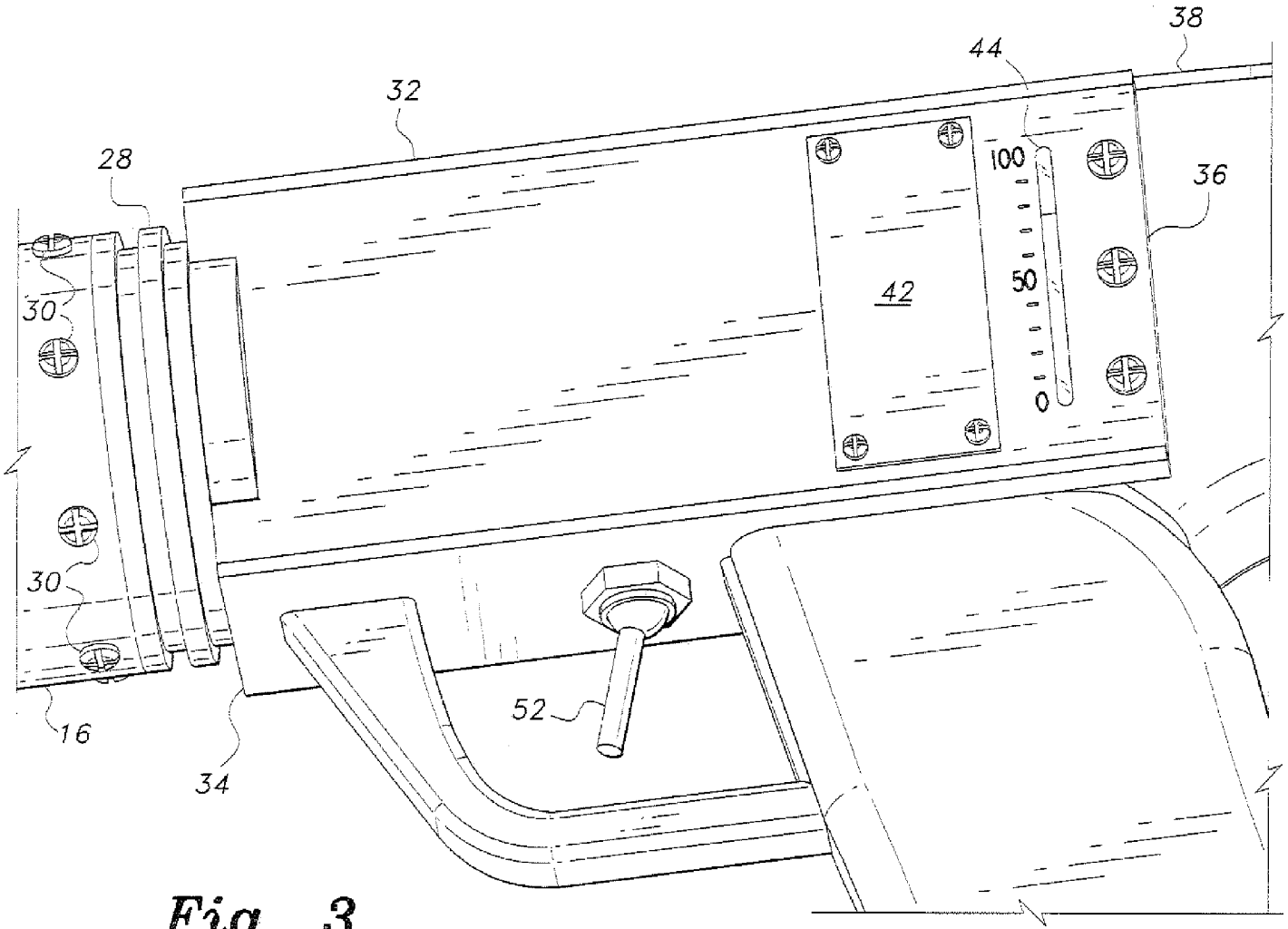
FIG. 3 is a partial left side elevation view of the shoulder-fired grenade launcher of FIG. 1, showing the trigger, battery compartment, and battery voltage indicator.
Figure 4:
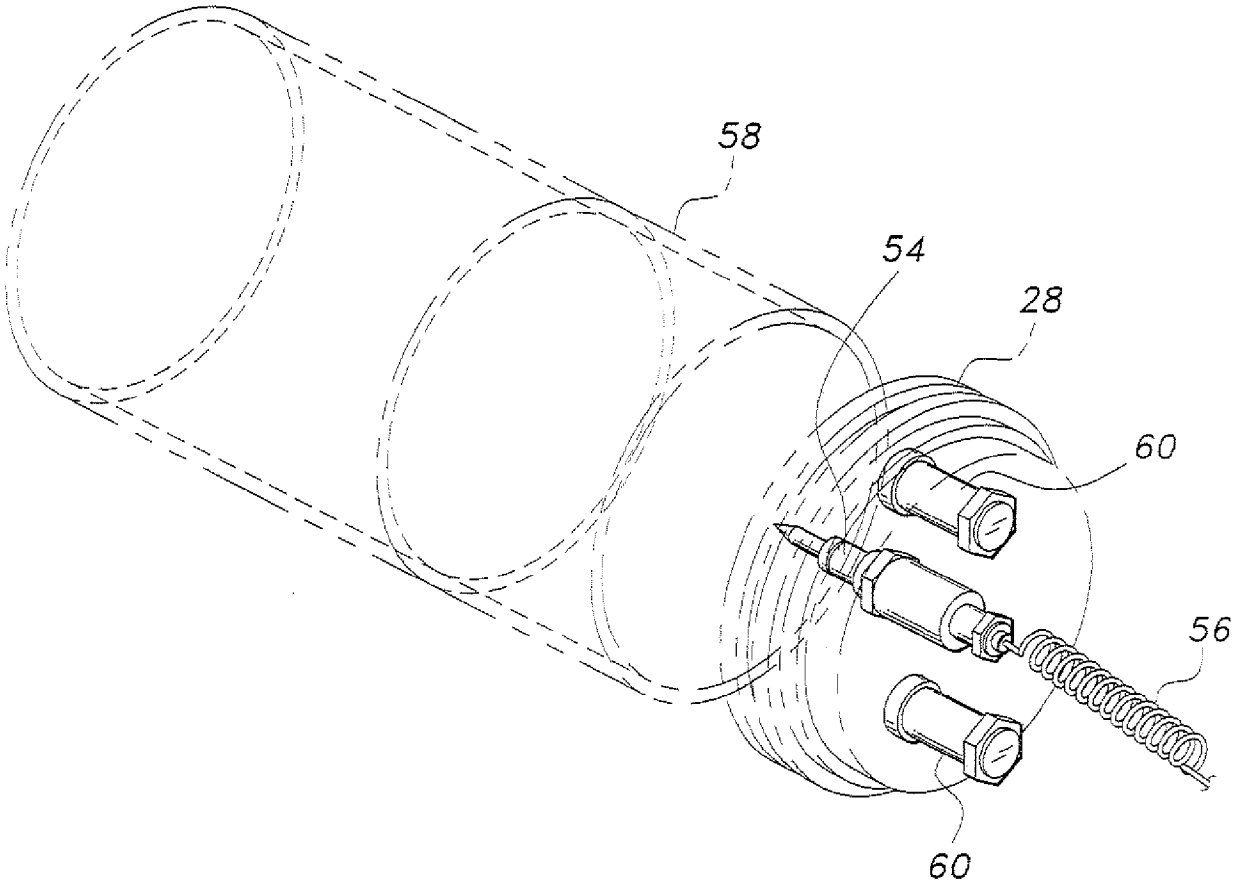
FIG. 4 is a perspective view of the electrical firing contact and attachment of the plate between the chamber and action of the shoulder-fired grenade launcher of FIG. 1, the plate and the grenade shell or round being shown in broken lines.
Figure 5:
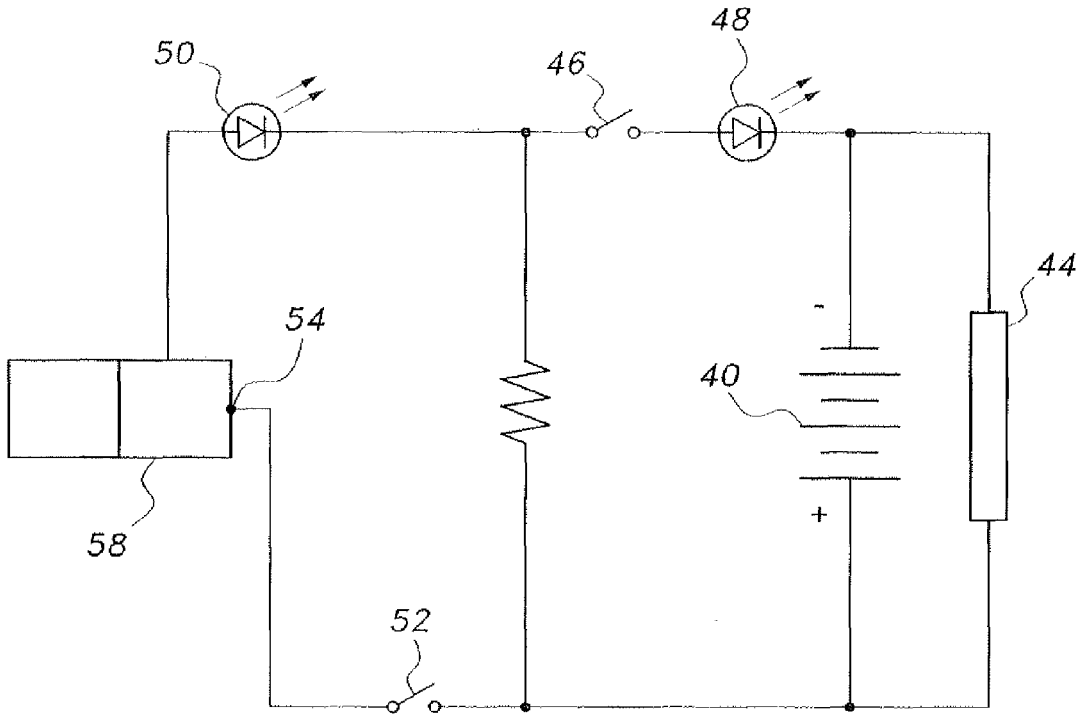
FIG. 5 is a schematic diagram of the firing circuit of the shoulder-fired grenade launcher of FIG. 1.

The action 32 of the grenade launcher 10 contains the firing mechanism for the weapon. FIG. 2 of the drawings provides a detailed pictorial illustration of most of this firing mechanism. FIGS. 3 and 4 illustrate other details and components, and FIG. 5 provides a drawing of an exemplary electrical circuit for the weapon. The firing mechanism or circuit is powered by an electrical storage battery 40, shown schematically in the electrical circuit of FIG. 5. The battery 40 may be a nine-volt dry cell type. The battery 40 may be a rechargeable unit, if desired. The battery 40 is installed within the action 32 behind a battery access panel or door 42 in the left side of the action 32, as shown in FIG. 3. An electrical power status indicator 44 is provided on the action 32 adjacent the battery access panel 42. The status indicator 44 enables the operator of the weapon or grenade launcher 10 to readily determine the electrical charge of the battery 40. The electrical power status indicator 44 may be a linear voltmeter providing a readout in volts, percentage of usable power, estimated battery life, or other parameter.

The battery or other electrical power source 40 is electrically connected in series with a safety switch 46 located on the action 32 or other convenient location, illustrated pictorially in FIGS. 1 and 2 and in the electrical schematic of FIG. 5. The safety switch 46 is preferably a slide type switch, as shown in FIG. 2 of the drawings, but other switch types may be used. A pair of status indicator lights are also provided, preferably adjacent the safety switch 46. The first indicator light 48 is connected in series between the battery or power source 40 and a ground back to the battery, and is illuminated (e.g., red, or other color as desired) when the safety switch 46 is closed. This portion of the circuit is in parallel with the trigger switch in order to operate when the trigger switch is open, i.e., the weapon is not actually being fired. A resistor may be included in the ground circuit for the indicator light 48 in order to restrict current flow therethrough to provide sufficient current to operate the firing mechanism when the trigger switch is actuated. A second indicator light 50 showing the overall status of the electrical system is connected in series with the electrical trigger switch 52, and is illuminated when both the safety switch 46 and the trigger switch 52 are closed to fire the grenade launcher weapon 10. This second indicator light 50 may be blue, or other color.

The electrical trigger switch 52 is placed in series with the battery or electrical power source 40 and the electrical firing contact 54 to depend from the bottom portion of the action 32. The firing contact 54 is shown most clearly in FIG. 4 of the drawings. The trigger switch 52 may be a spring-loaded, momentary contact, normally off electrical switch in order to simulate the feel of a mechanical trigger. The trigger switch 52 is illustrated as a toggle switch in the various drawings to indicate its electrical principle of operation, but it will be understood that the extended portion of the switch that is manipulated to actuate the circuitry may be configured as a conventional weapon trigger.

When the safety 46 is turned off, i.e., the firing circuit is closed and the trigger switch 52 is actuated, electrical current flows from the power source 40 through a coil spring electrical conductor 56 (shown in FIG. 2) extending from the safety switch and trigger wiring to the electrical firing contact 54 (best shown in FIG. 4) to fire the charge in the grenade shell or round 58, shown in broken lines in FIG. 4 of the drawings. The chamber end plate 28 includes a firing contact passage therethrough. The firing contact 54 is electrically insulated from the chamber end plate 28 and other structure. The electrical circuit for firing the shell or round 58 is completed through a ground path comprising the shell of the grenade round 58 through the chamber end 16 of the barrel 12, thence to the chamber end plate 28 to the action 32, wherein the battery or other power source 40 is grounded. FIG. 4 also clearly shows the two diametrically opposed bolts or other threaded fasteners 60 that secure the chamber end plate attachment end 34 of the action 32 to the chamber end plate 28. These bolts or fasteners are positioned on opposite sides of the firing contact 54.

The grenade launcher weapon 10 is a muzzle-loading type weapon, i.e., the chamber 16 is permanently closed and cannot be opened to load the weapon or to remove a spent round or shell. The operator of the weapon 10 loads the weapon as required by inserting the round into the muzzle of the weapon. The safety switch 46 is moved to the off position (which closes the safety circuit to illuminate the first indicator light 48 and provide electrical power to the trigger switch), the weapon is aimed, and the trigger switch 52 is actuated to fire the weapon. The spent shell is removed from the barrel 12 by accessing the forward end of the shell within the reliefs 18 in the muzzle end 14 of the barrel 12. Another round may be loaded into the barrel 12 as described above so that the grenade launcher weapon 10 is readied to fire another round.

It is to be understood that the present invention is not limited to the embodiments described above, but encompasses any and all embodiments within the scope of the following claims.

I claim:

1. A muzzle-loading, shoulder-fired grenade launcher, comprising:

a barrel having a muzzle end and a chamber end opposite the muzzle end, the barrel configured to receive a grenade therein via the muzzle end;

a chamber end plate disposed over the chamber end of the barrel; a plurality of radially disposed screws securing the chamber end of the barrel to the chamber end plate such that the chamber end plate is fixed relative to and closes the chamber end of the barrel;

an action extending from the chamber end plate, the action having a chamber end plate attachment end and a stock attachment end opposite the chamber end plate attachment end;

an electrical firing contact disposed in the chamber end plate;

an electrical trigger switch depending from the action, the trigger switch communicating electrically with the firing contact; a coil spring electrical conductor physically disposed between the electrical firing contact and the trigger switch;

an electrical slide safety switch disposed in series with the trigger switch and the firing to contact, the safety switch being disposed upon the action;

an electrical power source disposed within the action, the electrical power source communicating electrically with the trigger switch, the safety switch, the firing contact, the trigger switch, the safety switch, and the power source defining an electrical circuit;

a first indicator light disposed in series with the safety switch, the first indicator light indicating the status of the safety switch;

a second indicator light disposed in series with the trigger switch, the second indicator light indicating the status of the electrical circuit; an electrical power status indicator disposed upon the action, the electrical power status indicator communicating electrically with the electrical power source; and a stock extending from the stock attachment end of the action.

2. The shoulder-fired grenade launcher according to claim 1, further comprising laterally opposed first and second reliefs disposed in the muzzle end of the barrel.

3. The shoulder-fired grenade launcher according to claim 1, wherein the trigger switch is a normally off, momentary contact toggle switch.

4. The shoulder-fired grenade launcher according to claim 1, wherein the electrical power source is a nine-volt dry cell battery.

5. The shoulder-fired grenade launcher according to claim 1, further comprising:

diametrically opposed, first and second threaded fasteners securing the chamber end plate attachment end of the action to the chamber end plate.

* * * * *